US005449310A

United States Patent [19]

Stengl et al.

[11] Patent Number: 5,449,310

[45] Date of Patent: Sep. 12, 1995

[54] METHOD FOR MANUFACTURING ROD-SHAPED SILICON STRUCTURES

[75] Inventors: Reinhard Stengl, Stadtbergen; Wolfgang Hoenlein, Unterhaching, both of Germany

[73] Assignee: Siemens Aktiengesellschaft, Munich, Germany

[21] Appl. No.: 222,597

[22] Filed: Apr. 4, 1994

[30] Foreign Application Priority Data

Apr. 2, 1993 [DE] Germany ..... 43 10 909.8

[51] Int. Cl.[6] ..... H01J 9/02; H01J 1/30

[52] U.S. Cl. ..... 445/24; 445/50; 156/657

[58] Field of Search ..... 445/24, 50; 156/649, 156/657

[56] References Cited

U.S. PATENT DOCUMENTS

| | | | |
|---|---|---|---|
| 3,970,887 | 7/1976 | Smith et al. | 313/309 |
| 5,145,435 | 9/1992 | Ayers | 445/24 |
| 5,201,681 | 4/1993 | Okunuki et al. | 445/24 |
| 5,211,707 | 5/1993 | Ditchek et al. | 445/24 |
| 5,228,878 | 7/1993 | Komatsu | 445/50 |

FOREIGN PATENT DOCUMENTS 0493676 7/1992 European Pat. Off. .

OTHER PUBLICATIONS

K. K. Chin et al., "Field Emitter Tips for Vacuum Microelectronic Devices", 8257a Journal of Vacuum Science & Technology A vol. 8, No. 4, Jul./Aug., 1990, pp. 3586–3590.

D. Liu et al., "Fabrication of wedge-shaped silicon filed emitters with nm-scale radii", Appl. Phys. Lett. 58 (10), Mar. 11, 1991, pp. 1042–1043.

T. Utsumi, "Keynote Address Vacuum Microelectronics: What's New and Exciting", IEEE Transactions on Electron Devices, vol. 38, No. 10, Oct. 1991, pp. 2276–2283.

*Primary Examiner*—Mark Rosenbaum
*Assistant Examiner*—Jeffrey T. Knapp
*Attorney, Agent, or Firm*—Hill, Steadman & Simpson

[57] ABSTRACT

Rod-shaped or cylindrical structures in the nm range on a substrate of silicon are manufactured. A first cylinder of silicon is selectively epitaxially deposited in the hole of a mask layer of oxide, and the mask layer is removed. The silicon is then oxidized to form an oxide layer having such a thickness that a thinner, second cylinder of silicon having practically the same height as the first cylinder remains. In a last step, this oxide layer is removed, so that the second cylinder forms a freestanding silicon rod on the surface of the substrate.

5 Claims, 2 Drawing Sheets

METHOD FOR MANUFACTURING ROD-SHAPED SILICON STRUCTURES

BACKGROUND OF THE INVENTION

1. Field of the Invention

The present invention is directed to a manufacturing method for rod-shaped silicon structures in the nanometer (nm) range, particularly for the manufacture of field emission electrodes.

2. Description of the Related Art

It is frequently necessary to produce cylindrical or rod-shaped structures in the nm range in the field of microelectronics. For example, such structures are particularly required in field emission microscopy. A cold cathode field emitter requires structures having a magnitude on the order of a few nanometers. Applications for quantum elements, for example luminescent structures, are also conceivable having diameters from four nm. The quality factors of various cold cathode emission tips are compared to one another dependent on their geometrical shape with respect to their current yield at a specific electrical voltage in the publication by T. Utsumi in IEEE Transactions on Electron Devices 38, 2276–2283 (1991). A cylinder rounded off at the tip has ideal geometry for a field emission tip. Such a structure is superior both with respect to stability as well as in terms of current yield by a factor of 3–10 compared to previously employed conical emitters. Cylindrical structures will therefore most likely become more significant in the future instead of the previously used, conical emitters. The comical emitters are, for example, produced by etching, specific vapor-deposition techniques or selective epitaxy. Sharpening such structures on silicon in an oxidation process is known, whereby anisotropic oxidation at the edges and tips is utilized.

SUMMARY OF THE INVENTION

It is an object of the present invention to provide a method for manufacturing rod-shaped or cylindrical structures in the nm range, particularly for the manufacture of field emitter electrodes.

This object is inventively achieved in a method for manufacturing small cylinders on a substrate of silicon, having the steps of producing a mask layer with a hole with a circular area having a first diameter on the substrate, depositing a first cylinder of silicon in the hole, removing the mask layer at least in a region around the first cylinder, oxidizing a surface of the silicon such that a second cylinder of a preselected second diameter and a preselected height of silicon remains from the first cylinder of silicon, and removing the oxidized silicon at least in a region around the second cylinder.

The method of the present invention achieves the objects in that a cylindrical structure of silicon is first produced on a silicon substrate and the diameter thereof is subsequently reduced in etching or oxidation steps. The diameter is thereby reduced in size with twice the etching or oxidation rate, whereas the height of the original cylinder is only insignificantly changed. An extremely thin cylinder of approximately the same height therefore remains on the silicon substrate after the removal of the oxide layer. This method therefore makes it possible to manufacture rod-shaped structures that are significantly higher than their diameter. Due to the arched upper side of the original cylinder and due to the properties of the oxidation process, this thinned cylinder results with a rounded tip.

A more detailed description of the method of the present invention with reference to the following figures is provided below.

DETAILED DESCRIPTION OF THE PREFERRED EMBODIMENTS

Figure 1:
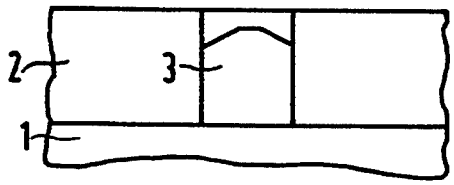
FIGS. 1–4 show a portion of the surface of the silicon substrate in cross-section after various method steps of the present invention.
Figure 2:
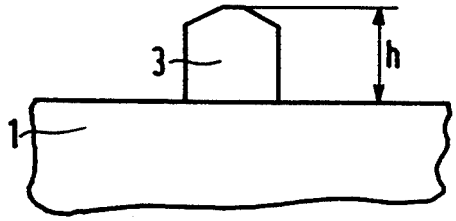
Figure 3:
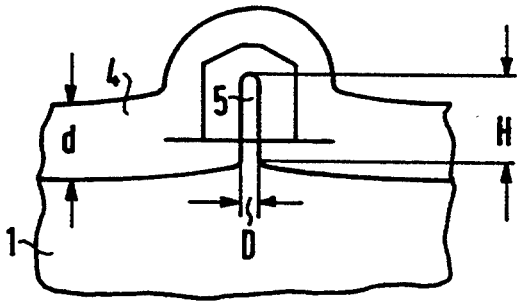
Figure 4:
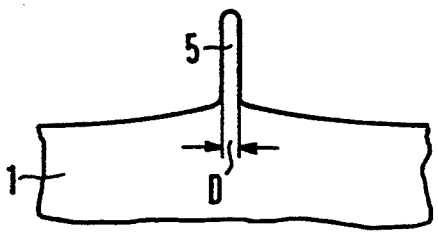

The basic method of the present invention begins with a substrate 1 of silicon (see FIG. 1). A mask layer 2 is produced on this substrate 1. For example, this mask layer 2 can be an oxide, particularly, for example, $SiO_2$. Basically, however, any material that is selectively etchable with respect to silicon is suitable as the material for this mask layer 2. A hole that uncovers the surface of the substrate 1 is produced in this mask layer 2, for example, by etching with a mask technique. A typical dimension for this hole is a diameter of 0.05 μm–0.5 μm. Silicon is then epitaxially and selectively deposited in this hole. The silicon grows in the hole up to the height of a first cylinder 3. After this, the material of the mask layer 2 is removed at least in the region around this first cylinder 3, for example by being etched off. The remaining first cylinder 3 is a freestanding, small tower of silicon having a typical height h of approximately 0.5 μm (See FIG. 2). By subsequently implementing a thermal oxidation, the diameter of this first cylinder 3 is reduced in size to such an extent that only a second cylinder 5 as shown in FIG. 3 remains. The remaining material of the first cylinder 3, as oxide, has swelled to the contour entered in FIG. 3. The height H of the second cylinder 5 of silicon is approximately equal to the height h of the first cylinder 3. The thickness of the second cylinder 5 can be dimensioned in conformity with the design desired by a suitable setting of the thickness d of the resulting oxide layer 4. The distance between the curved surfaces of the first cylinder 3 and of the second cylinder 5 is approximately 0.45 times the illustrated thickness d of the oxide layer 4. This results from the change in volume of the silicon during the oxidation. The diameter of the first cylinder 3 is therefore reduced in size by approximately 0.9 times the thickness d of the resulting oxide layer 4 as a result of this oxidation step. The thickness d of the oxide layer 4 can be set by monitoring the process parameters in this oxidation. Thus, the diameter of the manufactured, second cylinder 5 with a prescribed dimension (diameter D) can be obtained. For purposes of illustration, the contour of the first cylinder 3 is drawn together with a part of the substrate surface from FIG. 2 in FIG. 3. The result of this oxidation process after the removal of the oxide layer 4 is shown in FIG. 4. As illustrated, an extremely thin rod of silicon having a rounded tip is obtained in the method of the invention.

Figure 5:
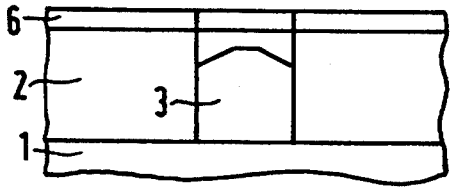
FIGS. 5–8 show corresponding portions after various method steps of the present invention in the manufacture of, specifically, a triode structure.

The method of the invention is especially suited for the manufacture of a triode structure. As in the method step of FIG. 1, silicon is selectively deposited in the hole of a mask layer 2. This mask layer 2 is additionally covered with a cover layer 6 here, as shown in FIG. 5. This cover layer is opened in the region of the hole of the mask layer 2. This opening, for example, can be produced together with the structuring of the mask layer 2 by etching with a mask applied onto the cover layer 6. Preferred materials for use in the method of the invention are, for example, oxide for the mask layer 2 and nitride for the cover layer 6. A critical criterion in the selection of the materials is that the mask layer 2 can be selectively etched with respect to the silicon of the first cylinder 3 and with respect to the cover layer 6 in a following method step. Moreover, the material of the cover layer 6 must be resistant to the oxidation step that follows and must be selectively etchable with respect to silicon. The layer thicknesses, for example, are 500 nm for the mask layer 2 and 100 nm for the cover layer 6. Conditions for the epitaxial deposition of the silicon are recited, for example, in EP 0 493 676 A1.

Figure 6:
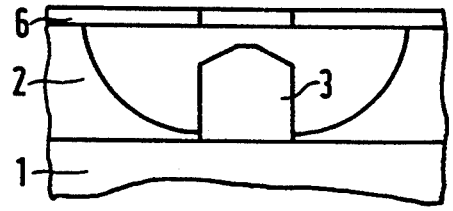
Figure 7:
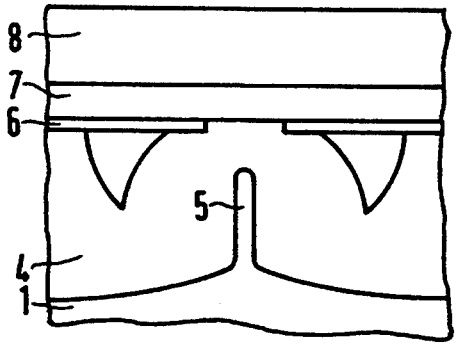
Figure 8:
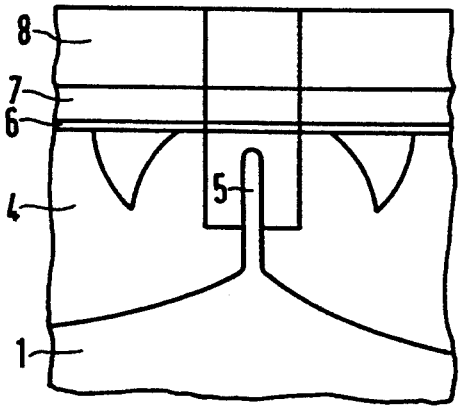

After the epitaxy, the material of the mask layer 2 is selectively and isotropically under-etched in the hole under the cover layer 6, as shown in FIG. 6. After this, the oxidation step analogous to FIG. 3 is implemented. The oxidation, however, is thereby implemented until the resulting oxide layer 4 extends at least approximately up to the height of the upper edge of the cover layer 6. An approximately planar surface thus results due to the upper side of the cover layer 6 and the upper side of the oxide layer 4. Further layers may be subsequently applied thereon. The required dimensions of the remaining, second cylinder 5 can be simultaneously maintained by properly selecting the layer thickness and the height of the first cylinder 3. In further method steps of the invention, an electrically conductive, highly-doped layer 7 and an insulator layer 8 are applied. Preferred materials for use in the present invention are, for example, polysilicon as the highly-doped layer 7, whereas the insulator layer 8 can be an oxide, for example, $SiO_2$, or borophosphorous silicate glass (BPSG). The highly-doped layer 7 (having a doping level of, for example, $10^{20}$ $cm^{-3}$ with phosphorous as the dopant) serves as gate electrode of the triode structure to be manufactured. The insulator 8 is produced, for example, with CVD (chemical vapor deposition). FIG. 7 shows the structure that has resulted. In order to uncover the thinned, second cylinder 5, which is intended to form a silicon electrode, a mask that serves for a following, multi-stage, anisotropic dry etching process is produced in a photo-technique. The layer sequence as shown in FIG. 8 is thereby etched out. The oxide of the oxide layer 4, the cover layer 6, the highly-doped layer 7 and the insulator layer 8 are removed in a region around the second cylinder 5. The dry etching process is selective relative to silicon, so that the second cylinder 5 of silicon that is manufactured remains standing. The structure of FIG. 8 can be provided with a further electrode as anode. For example, this anode can be produced by wafer bonding as in the above-referenced EP-0 493 676 A1.

Although other modifications and changes may be suggested by those skilled in the art, it is the intention of the inventors to embody within the patent warranted hereon all changes and modifications as reasonably and properly come within the scope of their contribution to the art.

We claim:

1. Method for manufacturing small cylinders on a substrate of silicon, comprising the steps of:

producing a mask layer having a hole with a circular area having a first diameter on said substrate;

depositing a first cylinder of silicon in said hole;

removing said mask layer at least in a region around said first cylinder;

oxidizing a surface of said first cylinder such that a second cylinder of silicon of a preselected second diameter and a preselected height remains from said first cylinder of silicon; and removing said oxidized portion of said first cylinder at least in a region around said second cylinder.

2. Method according to claim 1, wherein said producing step is further defined by providing said hole in said mask layer with said first diameter having a range between 0.05 $\mu$m and 0.5 $\mu$m.

3. Method according to claim 1, said method being further defined by providing for the manufacture of a triode structure, comprising the additional steps of:

covering said manufactured mask layer with a thin cover layer that is opened in the region of said hole and selecting materials of said mask layer and said cover layer such that said mask layer is selectively etchable with respect to said cover layer and said first cylinder;

retaining a preselected portion of said cover layer;

wherein said step of oxidizing said surface of said first cylinder thereby forms a substantially planar surface together with said preselected retained portion of said cover layer;

applying a highly-doped layer, selectively etchable with respect to silicon, to said cover layer to form a gate electrode; and etching through said highly doped layer.

4. Method according to claim 3, wherein said covering step is further defined by providing said mask layer as an oxide and said cover layer as a nitride.

5. Method according to claim 3, wherein said applying step is further defined by applying said highly doped layer of polysilicon and further applying an insulator layer of an oxide thereon.

* * * * *